United States Patent [19]

Huet

[11] Patent Number: 4,534,266

[45] Date of Patent: Aug. 13, 1985

[54] COMPOSITE ARMOUR PLATING

[75] Inventor: Roger Huet, Grenoble, France

[73] Assignee: Aluminum Company of America, Pittsburgh, Pa.

[21] Appl. No.: 187,843

[22] PCT Filed: Mar. 6, 1979

[86] PCT No.: PCT/FR79/00020

§ 371 Date: Nov. 8, 1979

§ 102(e) Date: Oct. 17, 1979

[87] PCT Pub. No.: WO79/00725

PCT Pub. Date: Oct. 4, 1979

[30] Foreign Application Priority Data

Mar. 8, 1978 [FR] France ..... 78 07538

[51] Int. Cl.[3] ..... F41H 5/04; B22D 19/02

[52] U.S. Cl. ..... 89/36.02; 164/108; 164/110; 428/545; 428/911

[58] Field of Search ..... 164/108, 110, 112, 98; 428/545, 593, 614, 686, 911; 89/36 A

[56] References Cited

U.S. PATENT DOCUMENTS

| | | | |
|---|---|---|---|
| 1,815,187 | 7/1931 | Coles | 428/593 |
| 3,324,768 | 6/1967 | Eichelberger | 89/36 A |
| 3,567,407 | 3/1971 | Yoblin | 428/593 X |
| 3,573,150 | 3/1971 | Broutman et al. . | |
| 3,705,558 | 12/1972 | McDougal et al. | 89/36 A X |
| 3,826,172 | 1/1974 | Dawson | 89/36 A |
| 3,970,136 | 7/1976 | Cannell et al. | 164/108 |
| 4,061,815 | 12/1977 | Poole . | |
| 4,197,341 | 4/1980 | Rule | 428/593 X |

FOREIGN PATENT DOCUMENTS

| | | |
|---|---|---|
| 719151 | 3/1942 | Fed. Rep. of Germany . |
| 1142689 | 2/1969 | United Kingdom . |

*Primary Examiner*—Nicholas P. Godici
*Attorney, Agent, or Firm*—Carl Lippert

[57] ABSTRACT

The invention relates to composite metal armour comprising ceramic inserts arranged in a regular manner within a metal casting. To ensure that the ceramic inserts are arranged at regular intervals within the metal, each of the inserts is provided with an encasing shell including male and female portions which are receivable into the male and female portions of adjacent inserts in order to maintain the inserts in a regular pattern during casting.

4 Claims, 4 Drawing Figures

COMPOSITE ARMOUR PLATING

The invention relates to a method of manufacturing composite metal components, inter alia cast armour plating, comprising ceramic inserts embedded in the component when the component is cast. The invention also relates to armour plating made by the method.

In some known methods of this kind, the ceramic inserts are first mixed with the liquid metal and the assembly is placed in a mould where the metal solidifies and holds the inserts in random positions, i.e. resulting from the position of each insert at the moment when the surrounding metal solidifies.

The inserts, owing to their random position, do not give reliable, reproducible ballistic efficiency. To obviate this unreliability, the armour is made thicker. The weight of the armour is a serious handicap for mobile devices, inter alia tanks, and the object of the invention is to construct armour plating having increased, reliable ballistic efficiency.

U.S. Pat. No. 3,705,558 discloses light-alloy armour comprising a layer of inserts made up of a pyramid of ceramic balls. This layer, which is placed at the centre of the armour, is a discontinuity which reduces the mechanical strength. The ceramic balls are in contact with one another and leave very small gaps for the liquid metal. The supports holding the balls in the mould may bend as a result of expansion caused by the liquid metal and softening after heating.

The method according to the invention aims to obviate these disadvantages and is characterized in that the ceramic inserts have positioning protuberances and are disposed and positioned by means of the protuberances in regular manner in the mould in a predetermined network to ensure ballistic efficiency and leave gaps between them for the liquid metal, and the liquid metal is poured into the mould so as to fill the gaps and embed the inserts, which are anchored and finely positioned in the armour plating when the metal solidifies.

The method according to the invention ensures predetermined positioning, thus advantageously securing the ceramic inserts in space at intervals which ensure the maximum ballistic efficiency, allowing for the direction in which the projectile comes.

The invention also relates to a method of constructing composite armour in which a metal shell is cast around each insert to embed it and the liquid metal forming the armour is cast without appreciably melting the shells.

According to one feature of the invention the ceramic inserts which can be spheres or cylinders or ovoid or prismatic, are embedded in a shell forming an individual metal cover having male and female portions for fitting the embedded inserts in one another so as to hold them in relative position.

The individual embedment of the inserts is made in a mould enabling the ceramic insert to be positioned in an invariable central place. The liquid metal is poured into the space between the mould and ceramic, thus embedding the insert and forming a shell having projecting tenons and hollow portions used for subsequent relative positioning in the armour proper. The inserts in their shells are prepared by eliminating any projections used for casting and any traces of joins which could interfere with the subsequent assembling of the inserts.

The cast metal armour plating is manufactured by placing the joined-together inserts in the mould and resting them on the mould walls in order to secure them when the mould is closed, thus preventing any displacement when the actual armour is cast.

The shell can be made of the same or different metal from the metal forming the armour, and the armour is cast under conditions chosen to prevent any melting of the shell surrounding the insert. It may be advantageous to heat the coated inserts before casting the metal armour, to prevent any surface reaction which may adversely affect the compactness of the armour. The embedment of the inserts permits an increased ballistic efficiency of the armour. The ceramics used are chosen for their ballistic properties and can e.g. be of the kind described in the previously-mentioned patent. Sintered aluminum oxide based inserts are of use.

In armour plating, inter alia thin plating, the inserts can be disposed in a single layer, aligned in a number of parallel rows, the spaces between the inserts in a single row and the spaces between the rows being sufficient to cast the liquid metal and properly fill the mould.

The inner mould surface can have positioning means, e.g. female portions, adapted to receive and engage the tenons of the inserts in order to obtain proper positioning. If the armour has a number of layers of inserts, it is advantageous to dispose them in staggered layers and/or in imbricated layers. The assembly formed by the inserts can constitute a three-dimensional structure disposed in regular manner in the armour. Spherical inserts can give spatial symmetry but are difficult to make. Cylindrical inserts preferably have a height equal to their diameter in order to preserve somme symmetry, and the axes of each pair of adjacent inserts are disposed perpendicularly in order to prevent any narrow passage between two adjacent surfaces.

The inserts are placed in the mould or in the network, either by hand or automatically in the case of mass production.

Other advantages and features will be clear from the following description of a number of embodiments of the invention given by way of non-limitative examples and shown in the accompanying drawings in which.

Figure 1:
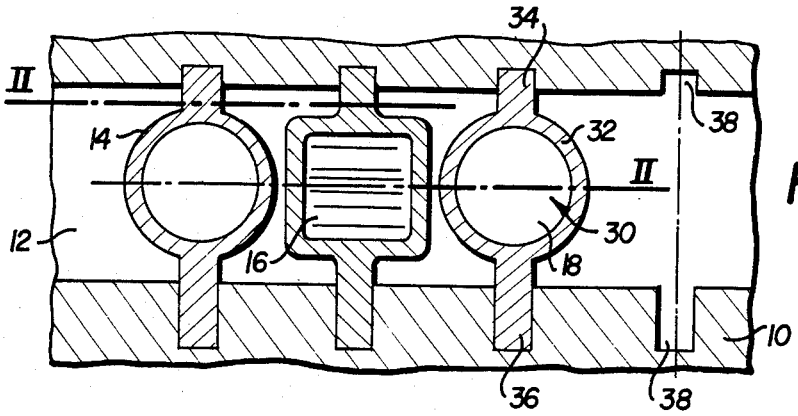
FIG. 1 is a digrammatic view in section of a mould for casting armour according to the invention.

In the drawings, a mould 10 for casting a plate, inter alia metal armour, bounds a chamber 12 adapted to be filled by metal liquid during casting. The mould and the method of casting are conventional and appropriate to the nature of the cast component, and need not be described.

Figure 2:
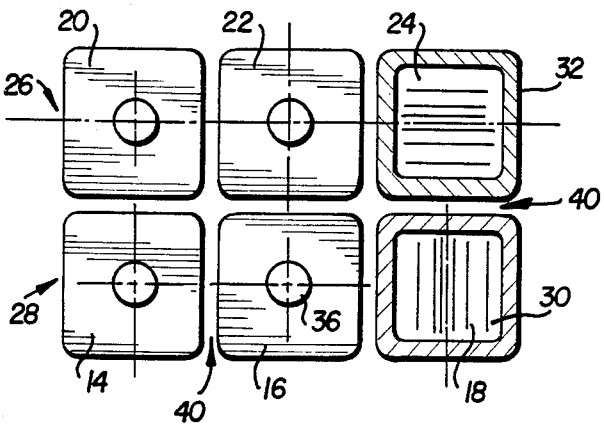
FIG. 2 is a section along the broken line II—II in FIG. 1 showing how the inserts are disposed.

Inserts are disposed in mould 10 and only six inserts 14, 16, 18, 20, 22, 24, grouped in two parallel rows 26 and 28, are shown in the drawings. Inserts 14–24 are all identical and each have a cylindrical ceramic core 30 embedded in a metal shell 32. Shell 32 has two diametrically opposite projections or tenons 34, 46. The ceramic inserts are manufactured and embedded beforehand by methods well known to the experts, e.g. they are embedded by moulding. The inner walls of mould 10 have pairs of facing blind holes 38 receiving the tenons 36 of inserts 14–24. The parts can be interlocked by hand or semi-automatically. It is easy to see that, after mould 10 has been closed, inserts 14–24 are positioned and held in the mould in a network determined by the position of holes 38. Spaces 40 are left between inserts 14–24 and are sufficiently large for the liquid metal to flow through them when mould 10 is filled. In the example illustrated in FIGS. 1 and 2, the height of the cylindrical inserts 14–24 is equal to their diameter and they are disposed regularly in a grid. The axes of each pair of adjacent inserts, e.g. 14, 16 or 14, 20, are perpendicular in order to facilitate the flow of liquid metal between the inserts.

The metal for embedding the inserts can be the same as or different from the metal used for the armour, and the whole is designed so as to prevent shells 32 melting when the armour is cast. Consequently, inserts 14–24 remain in the correct position. After the plate has been taken out of the mould, the projecting parts of tenons 36 can be removed by any appropriate means.

Of course, inserts 14–24 can have a different shape, e.g. prismatic or spherical, or some inserts can have a shape and/or size different from the others, in which case the positioning network will be adapted accordingly. The inserts can be relatively positioned by connections between them, thus simplifying the moulds.

The ballistic efficiency is increased by a multi-layer structure, in which case connections are provided between the inserts to form a cross-linked structure which can be inserted into mould 10.

Figure 3:
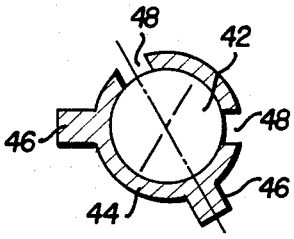
FIG. 3 is a diagrammatic section through an insert according to a variant of the invention.
Figure 4:
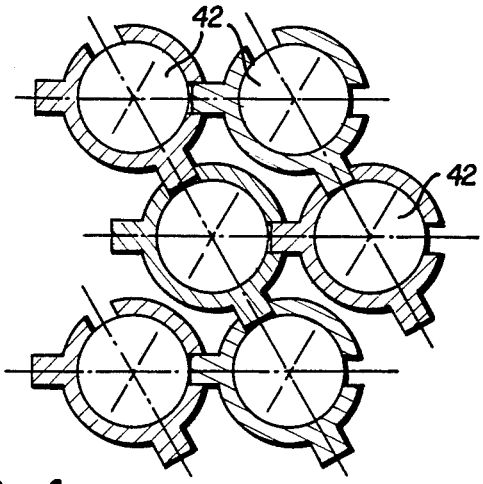
FIG. 4 shows how inserts according to FIG. 3 are fitted together.

FIG. 4 by way of example, illustrates a three-layer structure comprising an assembly of spherical inserts 42 of the kind shown in FIG. 3. Each insert 42 is embedded in a shell 44 having tenons 46 and diametrically opposite mortices 48 which can be fitted together in a predetermined spatial network in one or more layers. Advantageously, the inserts 42 are disposed in staggered rows and/or are made to partially overlap, by disposing the tenon/mortice pairs 46, 48 at an acute angle as illustrated in the drawings. The resulting cellular structure leaves spaces for liquid metal to flow between inserts 42 and, after the metal has solidified, the inserts are incorporated in the armour in well-defined positions.

Of course, the inserts can be joined by a different method, inter alia by bars which are received in associated orifices in the inserts or by cages which hold the inserts. The inserts are not necessarily embedded, even though embedded inserts are the preferred embodiment of the invention. The metal forming the armour can be steel or a light alloy or any other appropriate metal or alloy.

I claim:

1. A composite cast metal armour plating comprising:

a metal panel, and a plurality of individual ceramic inserts embedded in said panel and regularly arranged in a predetermined, ballistically efficient network, wherein each of said ceramic inserts includes a surrounding metal shell which is provided with at least one protrusion which is linkable with the shell of an adjacent ceramic insert to maintain said inserts in said predetermined network during casting.

2. A metal armour plating according to claim 1, wherein each of said metal shells includes at least one tenon and at least one conjugate mortice for receiving the end of an adjacent shell tenon.

3. A metal armour plating according to claim 1, wherein said ceramic inserts are cylindrical, and said predetermined network includes a plurality of rows and of layers of cylindrical ceramic inserts, and each insert includes a longitudinal axis which is perpendicular to the longitudinal axis of an adjacent ceramic insert in order to facilitate the flow of liquid metal between the inserts.

4. A process for forming a composite cast metal armour plating with embedded individual ceramic inserts comprising the steps of:

encasing ceramic inserts into encasing shells which comprise male and female bearings, stacking in a mould said individual ceramic inserts such that said male and female bearings engage each other so as to ensure that said inserts are arranged in a predetermined network with intervals between said inserts, and casting metal in said mould such that metal flows in said intervals and surrounds said ceramic inserts.

* * * * *

UNITED STATES PATENT AND TRADEMARK OFFICE

CERTIFICATE OF CORRECTION

PATENT NO. : 4,534,266

DATED : August 13, 1985

INVENTOR(S) : Roger Huet

It is certified that error appears in the above-identified patent and that said Letters Patent is hereby corrected as shown below:

On the title page, Item [56], "3,826,172 1/1974 Dawson ---89/36 A"

should read -- 3,826,172 7/1974 Dawson---89/36 A --.

Signed and Sealed this

Eighth Day of December, 1987

*Attest:*

DONALD J. QUIGG

*Attesting Officer*

*Commissioner of Patents and Trademarks*